US010888920B2

(12) United States Patent
Martin et al.

(10) Patent No.: US 10,888,920 B2
(45) Date of Patent: Jan. 12, 2021

(54) MONITORING AND CONTROL SYSTEM FOR CONTINUOUS CASTING MACHINE

(71) Applicant: Aktiebolaget SKF, Gothenburg (SE)

(72) Inventors: Kevin Martin, Doylestown, PA (US); Hanh Nguyen, Gothenburg (SE)

(73) Assignee: AKTIEBOLAGET SKF, Gothenburg (SE)

( * ) Notice: Subject to any disclaimer, the term of this patent is extended or adjusted under 35 U.S.C. 154(b) by 376 days.

(21) Appl. No.: 15/835,069

(22) Filed: Dec. 7, 2017

(65) Prior Publication Data

US 2018/0161861 A1 Jun. 14, 2018

Related U.S. Application Data

(60) Provisional application No. 62/431,631, filed on Dec. 8, 2016.

(51) Int. Cl.
*B22D 11/22* (2006.01)
*B22D 11/20* (2006.01)

(52) U.S. Cl.
CPC ..... *B22D 11/22* (2013.01); *B22D 11/20* (2013.01); *B22D 11/207* (2013.01)

(58) Field of Classification Search
CPC ..... B22D 11/20; B22D 11/207; B22D 11/22
USPC ..... 164/413, 454, 484
See application file for complete search history.

(56) References Cited

U.S. PATENT DOCUMENTS

2003/0145976 A1* 8/2003 Von Wyl et al. .. B22D 11/1206 164/459
2010/0319873 A1* 12/2010 Huellen et al. ..... B22D 11/16 164/451

FOREIGN PATENT DOCUMENTS

EP 0 269 493 A1 * 6/1988 ..... B22D 11/16

* cited by examiner

*Primary Examiner* — Kevin P Kerns
(74) *Attorney, Agent, or Firm* — J-Tek Law PLLC; Scott T. Wakeman; Mark A. Ussai

(57) ABSTRACT

A monitoring and control system is for a strand guide roll assembly of a continuous casting machine which includes a plurality of rolls spaced apart generally along a path of travel of a strand from an input end located adjacent to a mold to an output end. The system includes a plurality of sensors each coupled with a separate one of the rolls so as to be spaced apart generally along the travel path, each sensor senses magnitude of a load on the coupled roll. A logic circuit is coupled with each sensor so as to receive input from the sensors corresponding to load magnitude. The logic circuit is configured to determine from the sensor input a general position on the travel path at which the strand substantially solidifies, preferably by calculating a difference between loads on adjacent rolls and determining when the difference is less than a predetermined value.

18 Claims, 8 Drawing Sheets

MONITORING AND CONTROL SYSTEM FOR CONTINUOUS CASTING MACHINE

BACKGROUND OF THE INVENTION

The present invention relates to monitoring systems, and more particularly to a monitoring system for a continuous casting machine.

Continuous casting machines are known and basically include a tundish for receiving molten metal from a ladle, a mold for receiving a flow of the metal from the tundish and forming the metal into a strand and a plurality of rollers for transporting and/or forming the strand as it solidifies. The strand has a molten core as it leaves the mold and this core solidifies as the strand is conveyed by the rollers along a travel path to an output end, where the strand is cut-off or otherwise further processed.

SUMMARY OF THE INVENTION

A monitoring and control system is for a strand guide roll assembly of a continuous casting machine. The guide roll assembly includes a plurality of rolls spaced apart generally along a path of travel of a strand from an input end located adjacent to a mold to an output end. The monitoring system comprises a plurality of sensors each coupled with a separate one of the rolls so as to be spaced apart generally along the travel path, each sensor being configured to sense magnitude of a load on the coupled roll. A logic circuit is coupled with each one of the sensors so as to receive input from each sensor corresponding to sensed load magnitude. The logic circuit is configured to determine from the sensor input a general position on the travel path at which the strand substantially solidifies. Preferably, the logic circuit is configured to determine a difference between the sensed load magnitude from each one of the plurality of sensors and the sensed load magnitude from an adjacent one of the plurality of sensors spaced along the travel path from the one sensor and to provide data corresponding to location of the one sensor when the difference is less than a predetermined value.

A continuous casting machine comprises a tundish configured to contain a quantity of molten metal and a mold fluidly coupled with the tundish so as to receive molten metal from the tundish and configured to partially cool molten metal and to form the metal into a strand. A strand guide roll assembly includes a plurality of rolls spaced apart generally along a path of travel of the strand from an input end located adjacent to the mold to an output end. A control and monitoring system includes a plurality of sensors each coupled with a separate one of the rolls so as to be spaced apart generally along the travel path, each sensor being configured to sense magnitude of a load on the coupled roll. A logic circuit is coupled with each one of the sensors so as to receive input from each sensor corresponding to sensed load magnitude. The logic circuit is configured to determine from the sensor input a general position on the travel path at which the strand substantially solidifies. Further, the logic circuit is also configured to generate a control signal for adjusting a process parameter of the continuous casting machine so as to adjust the solidification position from the determined position toward a desired solidification position.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
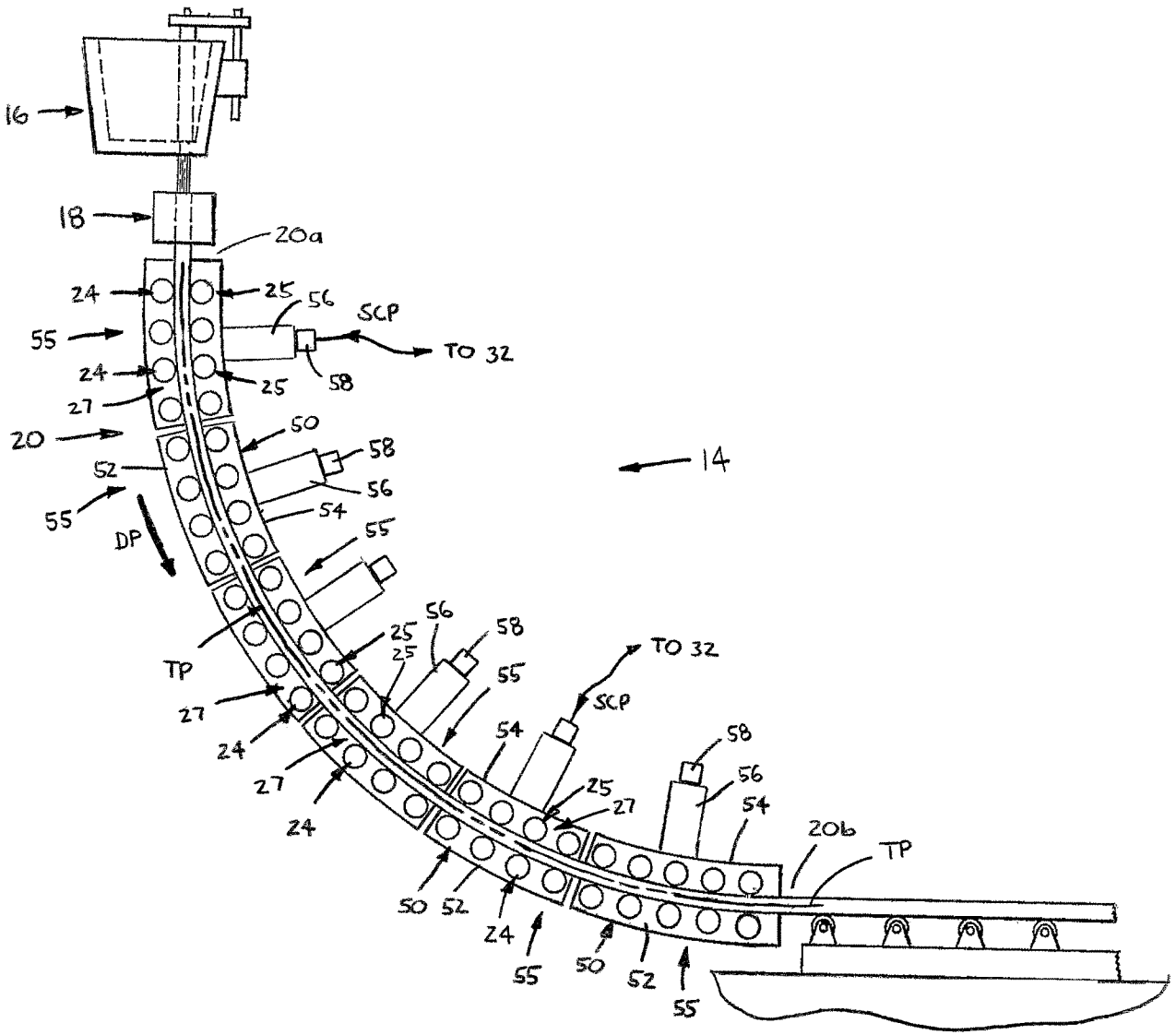
FIG. 1 is a side view of a continuous casting machine.

Certain terminology is used in the following description for convenience only and is not limiting. The words "upper", and "lower" designate directions in the drawings to which reference is made. Also, as used herein, the words "connected" and "coupled" are each intended to include direct connections between two members without any other members interposed therebetween, indirect connections between members in which one or more other members are interposed therebetween, and operative connections without any physical connection or attachment. The terminology includes the words specifically mentioned above, derivatives thereof, and words of similar import.

Referring now to the drawings in detail, wherein like numbers are used to indicate like elements throughout, there is shown in FIGS. 1-10 a monitoring and control system 10 for a strand guide roll assembly 20 of a continuous casting machine 14 for use with any appropriate metal (e.g., steel, aluminum, copper, etc.). The continuous casting machine 14 basically comprises a tundish 16 configured to contain a quantity of molten metal, a mold 18 fluidly coupled with the tundish 16 so as to receive molten metal from the tundish 16 and the strand guide roll assembly 20. The mold 18 is configured to partially cool molten metal and to form the metal into a strand 1, which preferably has generally rectangular cross-sections (see FIG. 8), opposing sides l*a*, l*b* and generally planar "lower" and "upper" surfaces 2A. 2B, respectively, but may have any other cross-sectional shape as desired. The guide roll assembly 20 handles the strand 1 as it emerges from the mold 18 and cools while being transported in a process direction DP along a travel path TP from an input end 20*a* adjacent to the mold 18 to an output end 20*b*, where the strand 1 is removed from the guide roll assembly 20 for subsequent finishing or processing. The guide roll assembly 20 includes a plurality of rolls 24 spaced apart generally along the travel TP between the input and output ends 20*a*, 20*b*, and are preferably provided in roll pairs 27 to guide both planar surfaces 2A, 2B of the strand 1 as described below.

Figure 7:
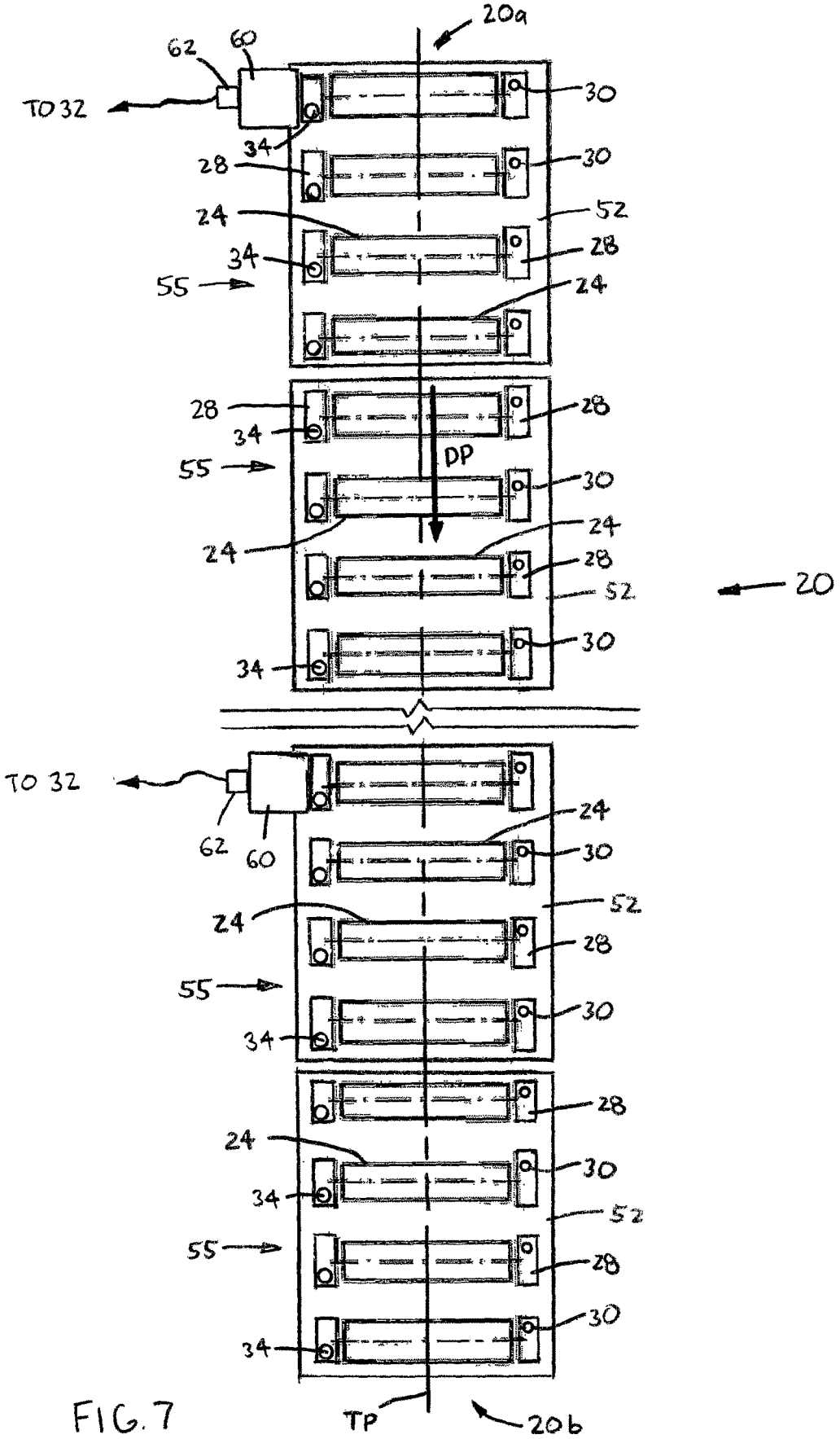
FIG. 7 is a top view of a "lower" half of a strand guide roller assembly.

Basically, the monitoring and control system 10 comprises a plurality of sensors 30 (e.g., $\mathbf{30}_1$-$\mathbf{30}_{14}$) each coupled with a separate one of the rolls 24 (e.g. $\mathbf{24}_1$-$\mathbf{24}_{14}$) so as to be spaced apart generally along the travel path TP and a logic circuit 32 coupled with each one of the sensors 30. Each sensor 30 is configured to sense magnitude Mb $ML_n$(e.g., $ML_1$, $ML_2$, $ML_3$, $ML_4$, $ML_7$, $ML_9$, $ML_{14}$, etc.) of a load on the coupled roll 24 exerted by the strand 1, which should vary along the travel path TP as the strand 1 solidifies, as described below. The logic circuit 32 is configured to receive input from each sensor 30 corresponding to sensed load magnitude $ML_n$ and to determine from the sensor input a general position PS on the travel path TP at which the strand 1 substantially solidifies. That is, the position or location PS on the path TP at which the stand's initially molten core 3 has cooled so that the entire strand cross-section is substantially solid metal, and is thus entirely solid from the solidification position PS to the output end 20*b*. Referring particularly to FIG. 7, the monitoring and control system 10 also preferably further includes a plurality of temperature sensors 34 spaced apart along the travel path TP and coupled with the logic circuit 32. The logic circuit 32 is configured to determine a temperature profile of the casting machine 14 along the travel path TP using input from the temperature sensors 34, which can be used to determine appropriate adjustments to various process parameters as described below.

Preferably, the logic circuit 32 is provided by a digital processor having memory and a software program loaded into the memory, such as a laptop or mainframe computer, a programmable logic controller, or any other digital electronic device capable of functioning generally as described herein. However, the logic circuit 32 may be provided by an analog computer hard-wired to provide the functionality as described generally herein and in detail below. As used herein, and the term "logic circuit" is intended to include or cover any known device or assembly capable of receiving and utilizing sensor input and preferably also controlling one or more process parameters, as discussed in detail below.

Figure 2:
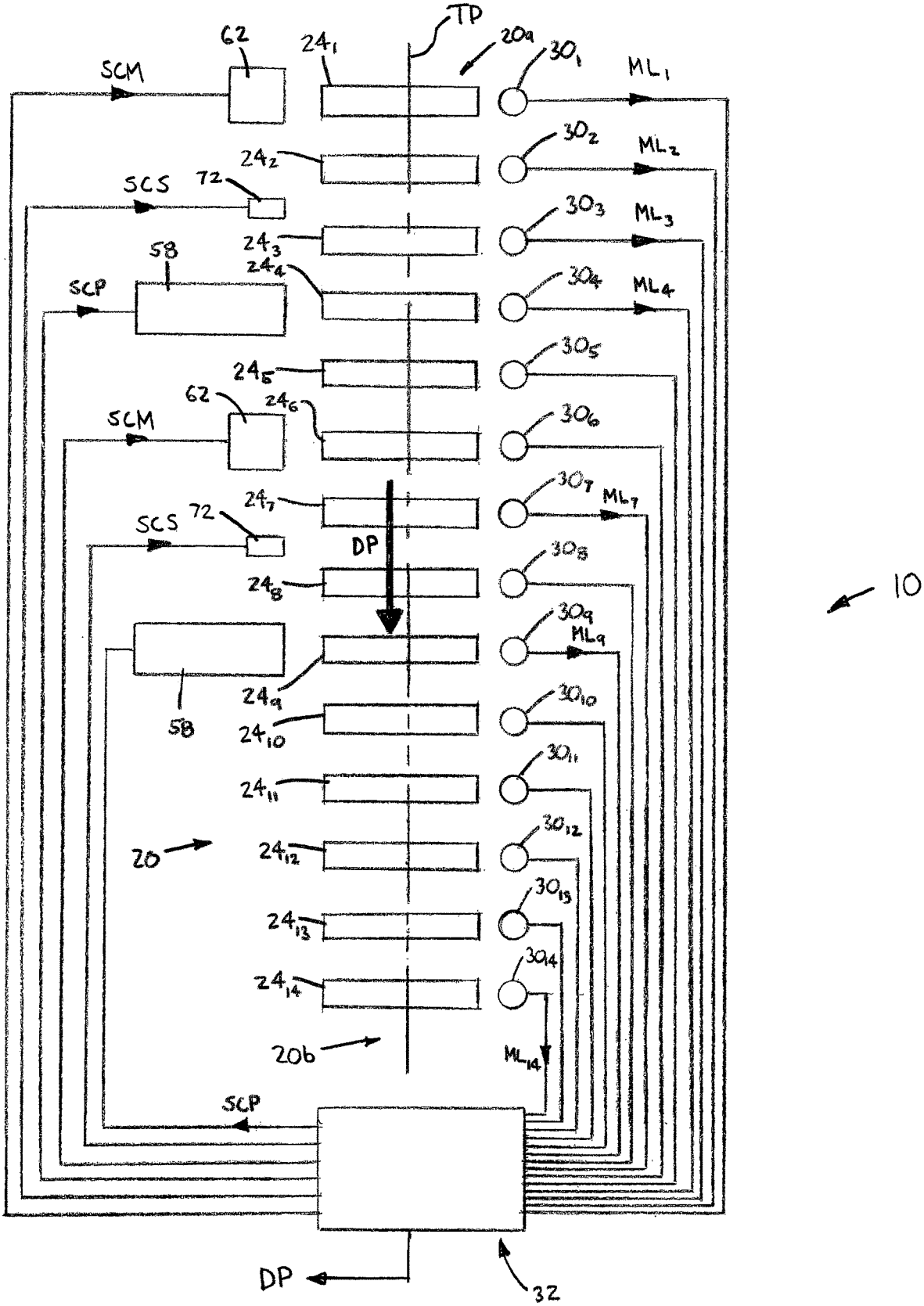
FIG. 2 is a more diagrammatic view of a strand guide roller assembly of a casting machine and a monitoring and control system of the present invention.
Figure 3B:
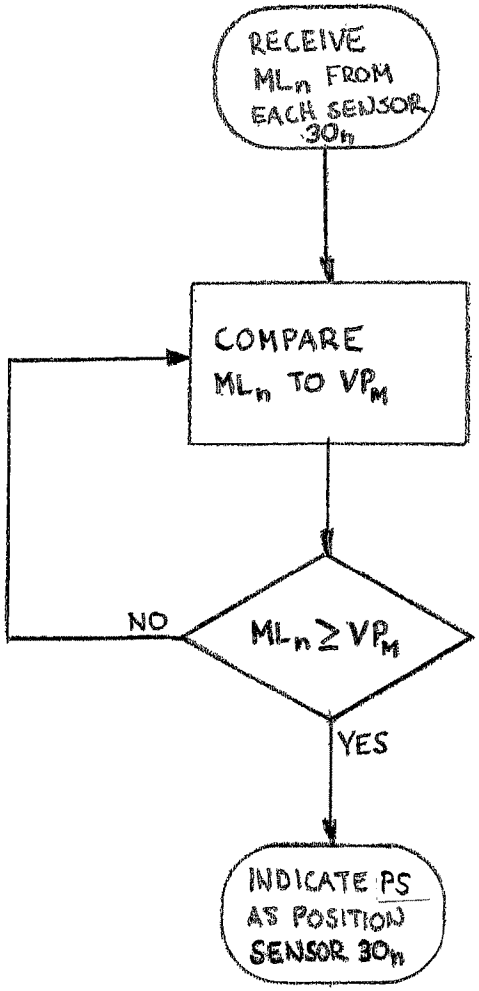
FIGS. 3A and 3B are each a flow diagram of two different methods of determining a strand solidification point using sensor data.
Figure 3A:
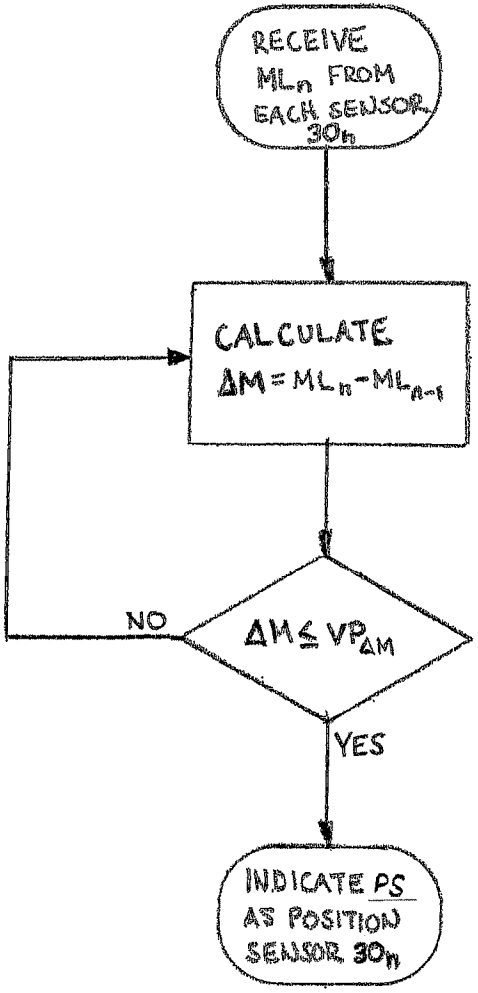

Referring to FIGS. 2 and 3A, the logic circuit 32 is preferably configured to determine the solidification position PS by determining or calculating a difference ΔM between the sensed load magnitude $ML_n$ from each one of the plurality of sensors 30 and the sensed load magnitude $ML_n$, from an adjacent one of the plurality of sensors 30 spaced along the travel path TP from the one sensor 30. Specifically, the logic circuit 32 calculates or otherwise determines the difference ΔM between the load magnitudes $ML_n$, sensed by each pair of adjacent sensors 30 spaced along the path, for example $\Delta M_3 = ML_3$(from sensor $\mathbf{30}_3$-$ML_2$(from sensor $\mathbf{30}_2$), as indicated in FIG. 2. When the load difference ΔM between two adjacent sensors 30 is less than a predetermined value $VP_{\Delta M}$, preferably close to zero, the loading on the sensors 30 has become generally constant, which indicates that the strand 1 has solidified or is close to solidifying.

More specifically, because the strand 1 has an initially molten core 3, a force exerted by the roll 24 on the strand 1 is resisted by a partially liquid strand, which generates a relatively lesser counter load exerted by the strand 1 on the roll 24. The counter force or load on the rolls 24 increases while the strand 1 is in the process of solidifying until the strand core 3 becomes substantially solid, after which point the load magnitude $ML_n$ remains generally constant (unless actively increased to reduce the strand thickness). Thus, by determining the location of the first two adjacent sensors 30 (i.e., first in the process direction DP) along the travel path TP for which the difference in loading ΔM is below the predetermined value $VP_{\Delta M}$, the logic circuit 32 determines the approximate or general location of the solidification position PS on the travel path TP.

Referring to FIG. 3B, alternatively, the logic circuit 32 may be configured to determine when one of the sensed load magnitudes $ML_n$ has least a predetermined value $VP_M$ that has been selected as being indicative of strand solidification. Such a predetermined value $VP_M$ may vary for a particular "set up" of the casting machine 14 depending on such factors as metal type (e.g., steel vs. aluminum), desired strand thickness, etc., as determined by empirical data, experimentation, theoretical analysis, etc. Further, the logic circuit 32 may be configured (programmed, etc.) to determine the general location of the strand solidification point PS using load data from the sensors 30 by any other appropriate algorithm or methodology, such as for example, by plotting all the load magnitude data and determining where the slope becomes substantially zero, or by any other appropriate data analysis process or procedure.

Furthermore, the solidification point could be detected by analyzing levels and frequency of the load that the hearing housings are exposed to. The effect from misalignment and geometry (slab and machine geometry) and also process parameters from the continuous casting machine may be used as well.

Preferably, the logic circuit 32 is also configured to provide data DP corresponding to the location of the solidification point PS, as indicated in FIG. 2. In the preferred method described above, the logic circuit 32 may transmit data DP corresponding to the location of either one of the two sensors 30 (or a position in between) for which the circuit 32 first determines a load magnitude difference ΔM of less than the predetermined value $VP_{\Delta M}$. If the logic circuit 32 instead determines solidification position PS by detecting the first sensor 30 having a predetermined load value $V_{PM}$, then the circuit 32 may transmit data corresponding to the location of the one sensor 30, or may transmit locational data of one or more sensors 30, or positions between sensors 30, as appropriate for the specific algorithm or method used. In any case, the logic circuit 32 preferably transmits such data DP by providing a visual indication of the determined solidification position PS on a monitor, screen, light panel, or other appropriate visual indicator, and/or by sending location data to a processor, controller, etc. However, the logic circuit 32 may alternatively be programmed or constructed such that no visual or other indicator or data is provided and the circuit 32 instead only adjusts a process parameter as described below.

Figure 5:
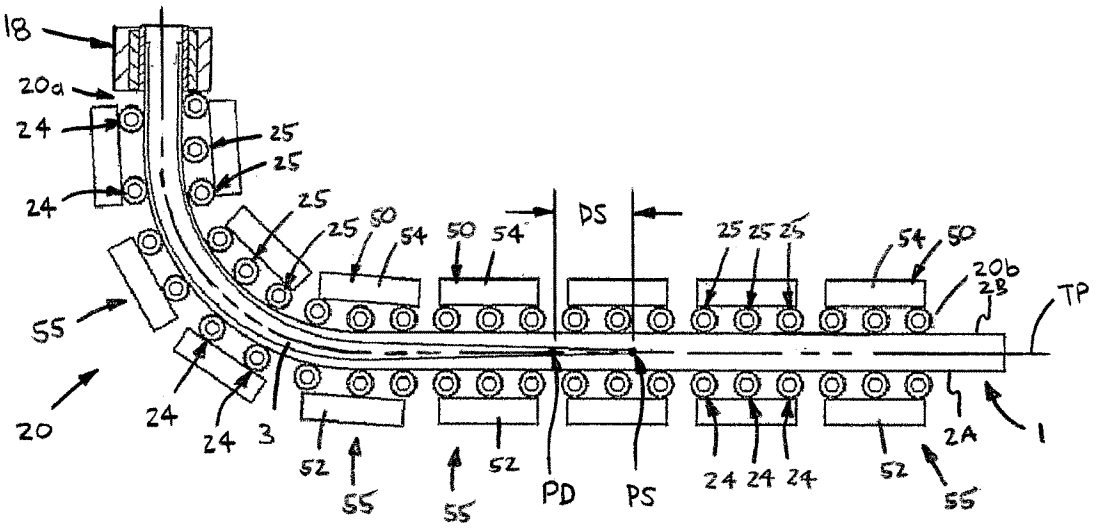
FIG. 5 is another view of the strand guide roller assembly of another continuous casting machine, showing a second solidification point spaced downstream from a desired solidification position.
Figure 6:
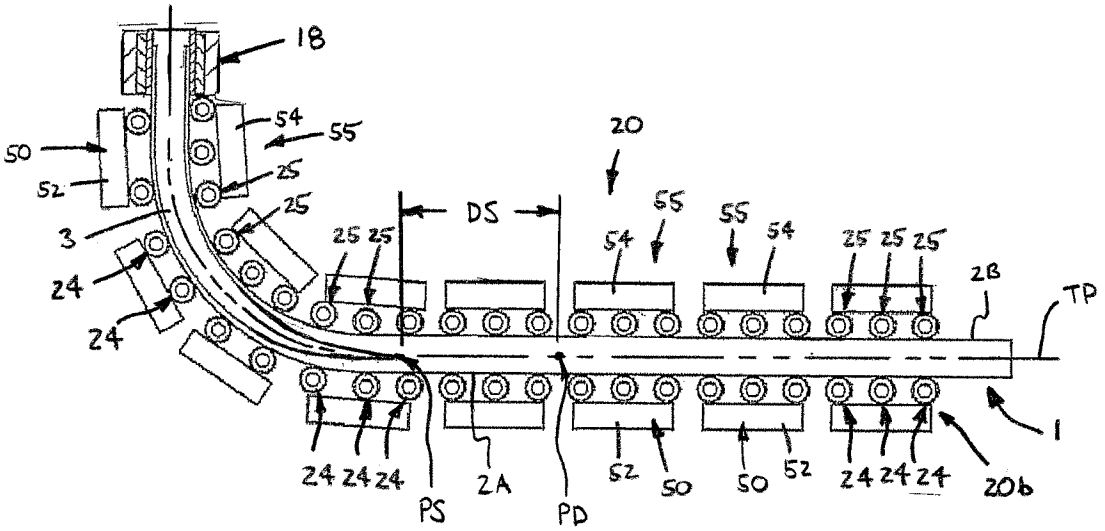
FIG. 6 is another view of the strand guide roller assembly of another continuous casting machine, showing a second solidification point spaced upstream from a desired solidification position.

Referring to FIGS. 2, 5 and 6, the logic circuit 32 is preferably also configured to calculate an adjustment of a process parameter of the casting machine 14 to adjust or shift the location at which the strand substantially solidifies from the determined position PS to another, desired position PD along the travel path TP. More specifically, the logic circuit 32 may be configured to compare the determined position PS of the solidification zone with a desired location PD and then calculate an adjustment to one or more process parameters of the casting machine 14 necessary to effectuate a shift or displacement DS of the determined solidification position PS to the desired solidification point PD. Such process parameters may be increasing or decreasing the rotational speed of drive rolls, the flow rate or volume of cooling fluid or/and the force exerted by the rolls 24 on the strand 1, among other potential process parameters, as discussed below. Most preferably, the logic circuit 32 is further configured to generate one or more control signal(s) SCP, SCM and SCS for adjusting or varying the process parameter(s) in order to effectuate the desired adjustment/displacement of the solidification position DS, such signal(s) SCP, SCM and SCS being sent to one or more actuators or controllers capable of adjusting the particular parameter(s), as described in detail below.

Figure 8:
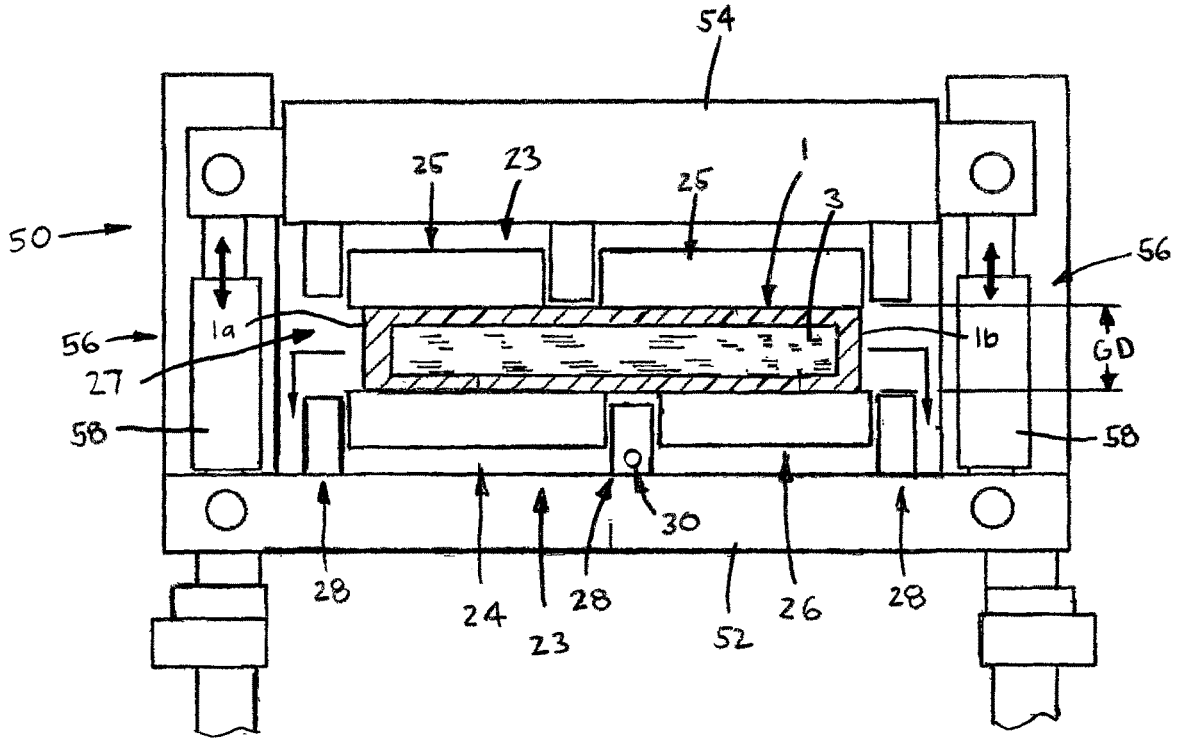
FIG. 8 is a cross-sectional view of guide roller assembly, taken in a plane generally perpendicular to a strand travel path.
Figure 9:
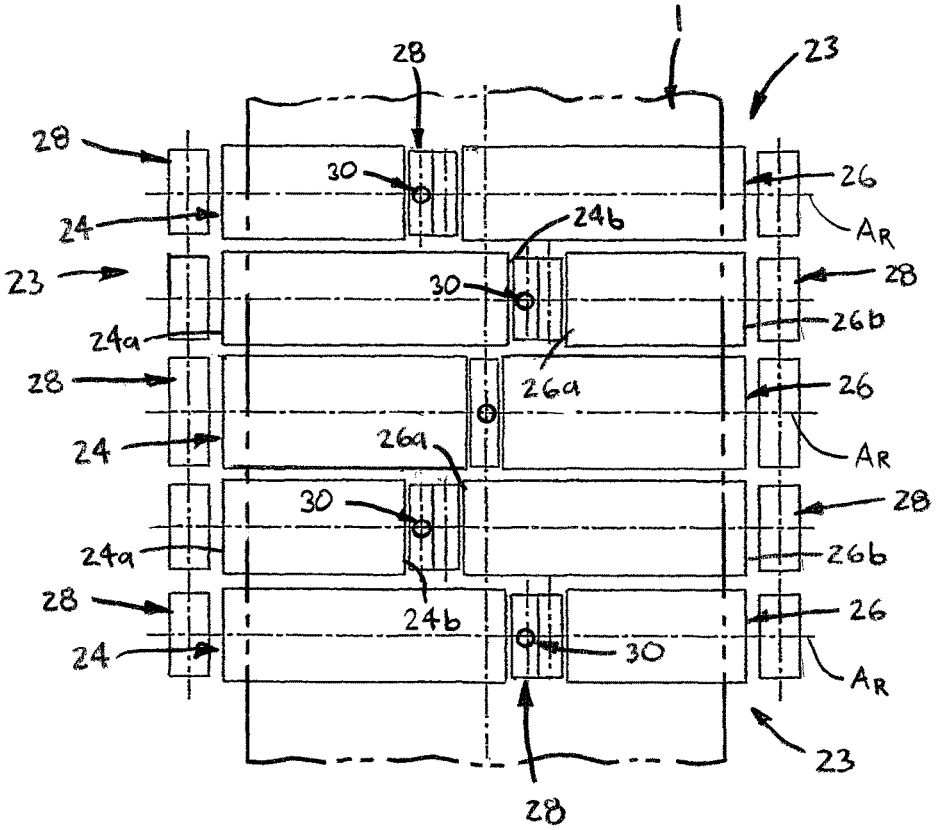
FIG. 9 is a top plan view of a guide roller frame assembly.

Referring to FIGS. 8 and 9, each one of the plurality of rolls 24 is preferably provided by a roll line 23 including one of the rolls 24 and at least one other roll 26, the at least two rolls 24, 26 being spaced apart along a common axis of rotation $A_R$. Each roll 24, 26 of the roll line 23 has opposing ends 24*a*, 24*b* and 26*a*, 26*b*, respectively, supported by a separate bearing (not depicted). The rolls 24 are preferably part of a roll line 23 including at least two rolls 24, 26, and possibly three or more rolls, in order to distribute loading and thereby enable increased load capacity as compared with a single standard roll. However, the rolls 24 may alternatively be provided as only a single roll if constructed of appropriate materials and/or sizing, as depicted in FIG. 7, particularly if used in a casting machine 14 designed for relatively smaller and/or lighter strands 1.

Figure 10:
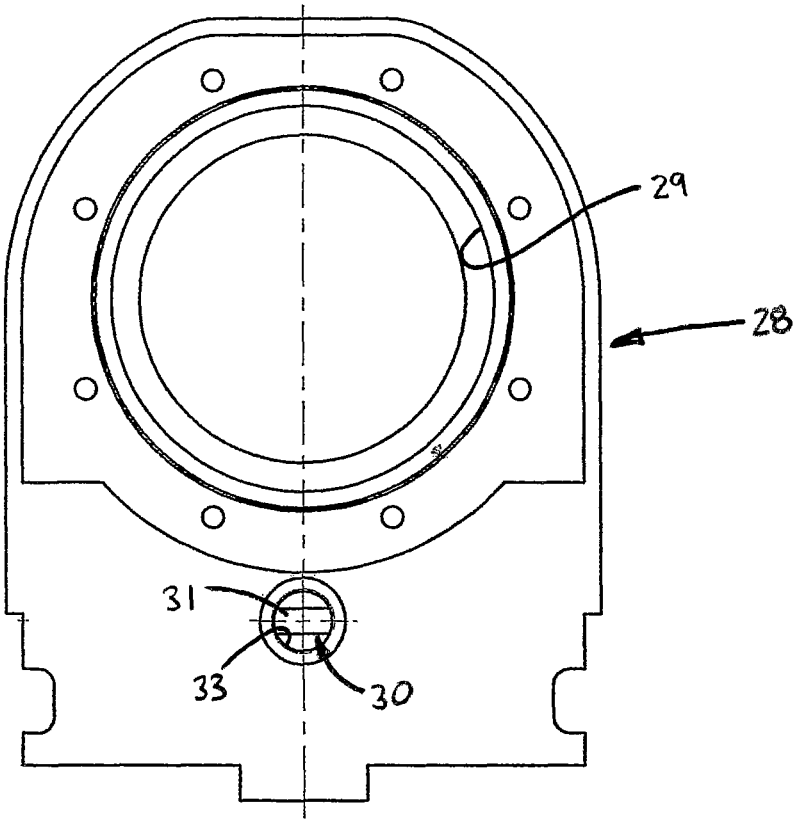
FIG. 10 is a front plan view of a bearing housing with a strain gauge sensor.

Referring particularly to FIG. 10, in any case, each sensor 30 is preferably mounted on or within a housing 28 of one of the two bearings supporting each one of the rolls 24 and is configured to sense loading on the enclosed bearing, which corresponds to loading on the supported roll 24. More specifically, each bearing is preferably disposed within a bore 29 in the housing 28 and each sensor 30 preferably includes a strain gage 31 mounted within a cavity 33 located beneath the bearing bore 29. Preferably, each strain gage 31 is either a metallic foil type or a fiber optic type, but may be any appropriate type of strain gage, and are each preferably provided with temperature compensation means to ensure accurate load measurements. Further, the sensors 30 may each alternatively be any other appropriate type of load sensor, such as for example, a piezoelectric crystal transducer, a linear variable differential transducer (LVDT), etc.

Referring to FIGS. 1 and 4-6, in a presently preferred embodiment, the casting machine 14 is a vertical caster with a bending zone, such that the strand 1 exits the mold in a generally vertical direction and is then turned or bended by the guide roll assembly 20 into a generally horizontal direction, as depicted. As such, the guide roll assembly 20 preferably includes both the plurality of rolls 24 with the coupled sensors 30, providing a first set of rolls 24, and a second set of rolls 25. Each one of the second set of rolls 25 is spaced apart generally perpendicularly with respect to the travel path TP from a separate one of the first set of rolls 24 so as to form a plurality of pair of rolls 27, the strand 1 passing between each one of the pair of rolls 27 when traversing the travel path TP. More specifically, the first set of rolls 24 are located on one, "lower" side of the travel path TP and support a first planar surface 2A of the strand 1 and the second set of rolls 25 are located on the other, "upper" side of the travel path TP and support a second, opposing planar surface 2B of the strand 1.

Although the casting machine 14 is preferably a vertical caster with bending, the casting machine may alternatively be a substantially vertical caster or even a horizontal casting machine (neither alternative shown). With a horizontal casting machine, the rolls 24 may be provided on one side (i.e., lower) of the travel path TP and supporting one "planar" surface (e.g., surface 2A) of the strand 1, and thus without the necessity of a pair of rolls 27 unless desired to use the rolls to reduce the thickness of the strand 1.

Referring now to FIGS. 1, 4-6 and 8, in the preferred construction, at least some of the first set of rolls 24 and/or the second set of rolls 25 are each displaceable generally perpendicularly with respect to the other roll 25, 24 in the associated pair of rolls 27, and thus also with respect to the travel path TP. Such displacement both adjusts a gap distance GD (FIG. 8) between the rolls 24, 25 of each roll pair 27 and the force or pressure exerted by each roll pair 27 on the strand 1. Although the rolls 24 and/or 25 may be individually movable or adjustable, the rolls 24 and/or 25 are more preferably adjustable as one or more units ("segments") including a subset of the entire number of the rolls 24, 25, as described below.

More specifically, the guide roll assembly 20 preferably includes at least one and most preferably a plurality of pairs 50 of first and second frames 52, 54, respectively, the frame pairs 50 being spaced apart generally along the travel path TP. A separate portion of the first set of rolls 24 is rotatably coupled with each one of the first frames 52 and a separate portion of the second set of rolls 25 are rotatably coupled with each one of the second frames 54. Each frame pair 50 and the robs 24 and 25 coupled with the frames 52, 54 respectively, form a separate "segment" 55, as is known in the art of metal casting. Preferably, each first frame 52 of each segment 55 is generally immovable or fixed and each second frame 54 of each segment 55 is adjustably movable with respect to the first frame 52, as described below. Alternatively, the second frames 54 may be fixed and the first frames 52 may be movable, or both frames 52, 54 may be adjustably movable. In any case, the movement of one frame 52 or 54 with respect to the other frame 54, 52 of the segment 55 varies both the gap distance GD between all the roll pairs 27 mounted within the segment 55 and the loading, i.e., force or pressure, exerted on the strand 1 by each of these roll pairs 27.

Referring to FIGS. 1, 2 and 8, with the structure described above, the guide roll assembly 20 preferably further includes at least one and most preferably a plurality of positioners 56 each coupled with one of the first and second frames 52, 54 of a separate frame pair 50, and at least one actuator 58 operatively coupled with a separate one of the positioner(s) 56. Each positioner 50 is configured to displace the coupled frame 52, 54, preferably one of the second frames 54 as described above, in opposing directions generally perpendicular to the travel path TP. Thereby, the positioners 56 adjustably position the roll pairs 27 within the associated frame pair 50 to vary gap distance GD and/or the pressure or loading of the roll pairs 27 on the strand 1, as discussed above. Each frame pair 50 may be adjusted by a single positioner 56 (FIG. 1) or two or more positioners 56 (FIG. 8). Further, each positioner 56 may be constructed of any appropriate type, such as for example, hydraulic cylinders, motor-driven power screws, etc., and may include an appropriate mechanism to transmit positioner movement to desired frame displacement. Furthermore, each actuator 58 is constructed as appropriate to operate the coupled positioner, such as for example, a valve to operate a hydraulic or pneumatic cylinder, a motor to operate a power screw, etc.

With the structure described above, the logic circuit 32 is operatively coupled with each one of the actuators 58 and is configured to transmit a control signal SCP to the actuator 58. As such, the positioner 56 displaces at least one roll 24 or 25, and preferably a plurality of rolls 24, 25 within one frame 52 or 54, respectively, when the actuator 58 receives the control signal SCP, so as to adjust the gap GD to a desired dimension and/or the amount of loading (i.e., force or pressure) exerted on the strand 1 by the one or more roll pairs 27 to a particular magnitude. Most preferably, the logic circuit 32 is configured to calculate a change in loading exerted by the roll pairs 27, which may be theoretically derived or based on empirical data, which will effectuate a desired solidification point displacement DS, either alone or in combination with changes to other process parameters.

More specifically, a series of tests may be conducted on different forces/pressures applied by the rolls 24, 25, 26 on a strand 1 at various gap dimensions GD, temperatures, etc. to determine a correlation between applied forces, gap dimension, etc. and adjustment or displacement DS of the solidification point PS. Alternatively, the logic circuit 32 may be programmed or constructed to determine an appropriate adjustment of the roll force applied on the strand 1 and/or gap dimension GD using a theoretically derived model or equation believed to appropriately correlate these variables with desired solidification point displacement DS. In either case, the logic circuit 27 then transmits an appropriate control signal SCP to one or more of the positioner actuators 58 to effect the desired solidification point displacement DS.

Referring now to FIGS. 2 and 7, at least one and preferably a plurality of rolls 24 or/and rolls 25 are "driven" and are coupled with an electric motor 60 for rotatably driving the roll 24 or 25 about its central axis $A_R$. The driven rolls 24, in conjunction with the weight of the strand 1, establish the speed at which the strand 1 traverses the strand guide roll assembly 20, and thus the travel path TP. Further, the logic circuit 32 is operatively coupled with each electric motor 60 so as to adjust the motor rotation speed, either directly or through a motor controller 62, and thereby adjust or vary the rotational velocity of each driven roll 24 or 25. Specifically, the logic circuit 32 may either directly adjust motor speed by varying voltage, current, etc., to the motor 60 or may send a control signal SCM to the controller 62 operating the motor 60.

Thereby, the logic circuit 32 may vary the speed of traversal of the strand 1 along the travel path TP by adjusting the motor speed of the one or more driven rolls 24 in order to shift the solidification point from the determined position PS to a desired position PD. Specifically, the motor drive speed may be increased to shift the determined solidification position PS in a direction toward the output end 20*b* of the guide roll assembly 20 (i.e., the process direction DP) or decreased to shift the solidification point in a direction toward the guide roll assembly input end 20*a*. Preferably, the logic circuit 32 is configured to calculate a motor speed adjustment that will shift the solidification point PS by a desired distance or/and to a desired to a desired extent, either alone or in conjunction with adjustment of other process parameters, and to either transmit a control signal SCM to the controller(s) 62 or directly adjust current or voltage to the motor(s) 60, in order to effectuate the desired solidification point displacement DS.

More specifically, a series of tests may be conducted at different motor speeds, temperatures, etc. to determine a correlation between speed of the strand 1 along the travel path and displacement of the solidification point PS. Alternatively, the logic circuit 32 may be programmed or constructed to determine an appropriate adjustment of motor speed using a theoretically derived model or equation believed to appropriately correlate these variables with desired solidification point displacement DS. In either case, the logic circuit 32 then transmits an appropriate control signal SCM to the motor controller(s) 62, or directly adjusts motor current or voltage of the one or more motors 60, to cause the solidification point PS to shift or displace by the desired distance DS.

Figure 4:
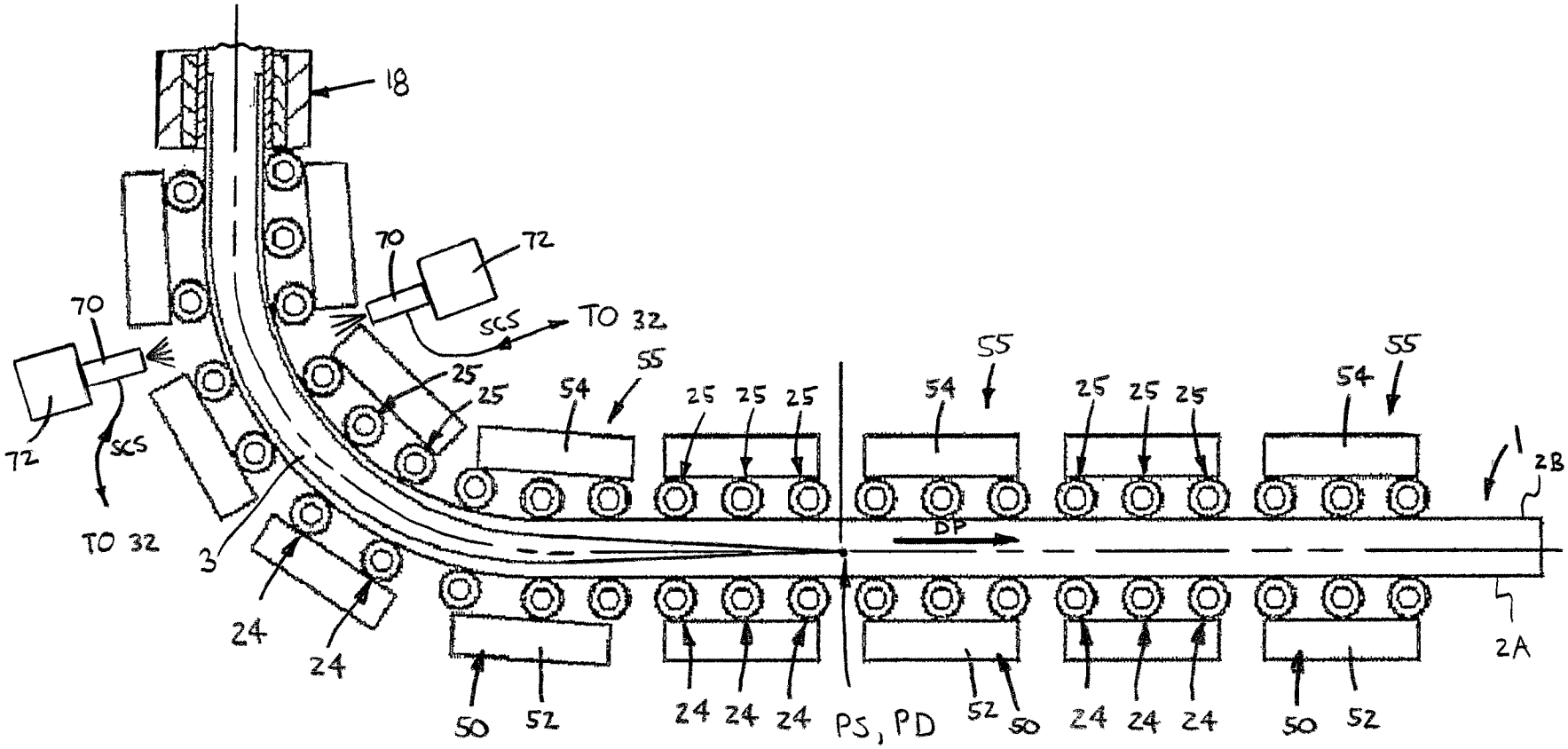
FIG. 4 is a side view of a strand guide roller assembly of another continuous casting machine, showing a first, desired solidification point.

Referring now to FIGS. 2 and 4, the casting machine 14 preferably further comprises at least one and preferably a plurality of sprayers 70 each configured to discharge cooling fluid (e.g., water, air, etc.) on the strand 1 and one or more actuators 72. Each actuator 72 is configured to control flow through one or more of the sprayers 70 and the logic circuit 32 is operatively coupled with each one of the actuators 72. The actuators 72 may each be a valve controlling the volume of flow through a nozzle, a regulator controlling the volume or flow rate of a pump, or any appropriate device for controlling flow rate or volume (none shown). Further, the logic circuit 32 is configured to operate each actuator 72 such that each actuator 72 adjusts the flow of the cooling fluid from the coupled sprayer 70 onto the strand 1, preferably by means of a control signal SCS sent from the circuit 32 to the actuator 72.

As such, if the logic circuit 32 determines that the strand solidification point PS is located too far upstream of a desired position PD on the travel path TP, and is thus solidifying too quickly or the strand 1 is moving too slowly, the logic circuit 32 may transmit a control signal SCS to one or more actuators 72 in order to reduce flow rate or volume through the sprayers 70 to thereby reduce the rate of cooling of the strand 1. Conversely, if the logic circuit 32 determines that the strand solidification point PS is located too far downstream of a desired position PD on the travel path TP, and is thus solidifying too slowly or the strand 1 is moving too quickly, the logic circuit 32 may then transmit a control signal SCS to one or more sprayer actuators 72 to increase the flow rate and/or volume through the sprayers 70 in order to reduce the rate of cooling of the strand 1.

Preferably, the logic circuit 32 is configured to calculate a flow adjustment that will shift the solidification point PS by a desired distance or extent, either alone or in conjunction with adjustment of other process parameters, and to transmit the control signal SCS to the actuator(s) 72 in order to effectuate the desired solidification point displacement DS. As with the other process parameters, the effect of varying the flow of cooling fluid on the location of the solidification point PS may be determined empirically through experimentation or calculated using an appropriate theoretical model. More specifically, a series of tests may be conducted at different sprayer flow rates or volumes, strand temperatures, etc. to determine a correlation between cooling fluid flow rate/volume and displacement DS of the solidification point PS. Alternatively, the logic circuit 32 may be programmed or constructed to determine an appropriate adjustment of sprayer flow rate/volume using a theoretically derived model or equation believed to appropriately correlate these variables with desired solidification point displacement DS. In either case, the logic circuit 32 then transmits an appropriate control signal SCS to one or more sprayer actuator(s) 72 to cause the solidification point PS to shift or displace by the desired distance DS toward the desired solidification position PD.

Most preferably, the logic circuit 32 is configured to coordinate adjustment of all of the various process parameters to achieve a desired solidification point displacement DS when the monitoring system 10 determines that the solidification point PS is located more than a predetermined distance from a desired solidification point PD. Depending on the particular operating conditions, the logic circuit 32 will make appropriate adjustments to the gap distance GD, the pressure exerted by the rolls 24, 25, 26, the speed of drive motors 60 and/or the cooling fluid flow rate/volume through the sprayers 70, and/or any other process parameters believed to effect the location of the solidification point PS.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally defined herein and in the appended claims.

We claim:

1. A monitoring and control system for a strand guide roll assembly of a continuous casting machine, the guide roll assembly including a plurality of rolls spaced apart generally along a travel path of a strand from an input end located adjacent to a mold to an output end, the monitoring system comprising:

a plurality of sensors each coupled with a separate one of the plurality of rolls so as to be spaced apart generally along the travel path, each one of the plurality of sensors being configured to sense magnitude of a load on a coupled roll; and a logic circuit coupled with each one of the plurality of sensors so as to receive input from each sensor corresponding to sensed load magnitude, the logic circuit being configured to determine from the sensor input a general position on the travel path at which the strand substantially solidifies;

wherein the logic circuit is further configured to calculate an adjustment of a process parameter of the casting machine to shift a location at which the strand substantially solidifies from the determined solidification position toward a desired solidification position on the travel path.

2. The monitoring system as recited in claim 1 wherein the logic circuit is configured to one of:

determine a difference between the sensed load magnitude from each one of the plurality of sensors and the sensed load magnitude from an adjacent one of the plurality of sensors spaced along the travel path from the one sensor and to provide data corresponding to location of the one sensor when the difference is less than a predetermined value; and determine when one of the sensed load magnitudes has least a predetermined value indicative of strand solidification and to provide data corresponding to location of the one of the plurality of sensors providing the one sensed load magnitude.

3. The monitoring system as recited in claim 2 wherein the logic circuit is further configured to generate a control signal for adjusting a process parameter of the continuous casting machine.

4. The monitoring system as recited in claim 3 wherein the control signal is transmitted to at least one of a drive motor, a controller operating a drive motor, and an actuator operating at least one of a cooling sprayer and a roll positioner.

5. The monitoring system as recited in claim 1 wherein the logic circuit is provided by an analog computer or a digital processor having memory and a software program loaded into the memory.

6. The monitoring system as recited in claim 1 wherein each sensor includes a strain gauge configured to sense loading on a bearing supporting an end of the coupled roll.

7. A continuous casting machine comprising:

a tundish configured to contain a quantity of molten metal;

a mold fluidly coupled with the tundish so as to receive molten metal from the tundish and configured to partially cool molten metal and to form the metal into a strand;

a strand guide roll assembly including a plurality of rolls spaced apart generally along a travel path of the strand from an input end located adjacent to the mold to an output end; and a monitoring and control system including:

a plurality of sensors each coupled with a separate one of the plurality of rolls so as to be spaced apart generally along the travel path, each one of the plurality of sensors being configured to sense magnitude of a load on a coupled roll; and a logic circuit coupled with each one of the sensors so as to receive input from each sensor corresponding to sensed load magnitude, the logic circuit being configured to determine from the sensor input a general position on the travel path at which the strand substantially solidifies and configured to generate a control signal for adjusting a process parameter of the continuous casting machine so as to adjust the solidification position from a determined position toward a desired solidification position.

8. The casting machine as recited in claim 7 wherein the logic circuit is configured to one of:

determine a difference between the sensed load magnitude from each one of the plurality of sensors and the sensed load magnitude from an adjacent one of the plurality of sensors spaced along the travel path from the one sensor and to provide data corresponding to location of the one sensor when the difference is less than a predetermined value; and determine when one of the sensed load magnitudes has least a predetermined value indicative of strand solidification and to provide data corresponding to location of the one of the plurality of sensors providing the one sensed load magnitude.

9. The casting machine as recited in claim 7 further comprising at least one sprayer configured to discharge cooling fluid on the strand and an actuator controlling fluid flow through the sprayer, the logic circuit being operatively coupled with the actuator such that the actuator adjusts the flow of cooling fluid onto the strand when receiving the control signal.

10. The casting machine as recited in claim 7 further comprising at least one drive motor configured to rotate one of the plurality of rolls and a controller configured to control rotational speed of the at least one drive motor, the logic circuit being operatively coupled with the controller such that the controller varies the rotational speed of the at least one drive motor when receiving the control signal so as to adjust a speed of traversal of the strand along the travel path.

11. The casting machine as recited in claim 7 further comprising a positioner for adjusting a position of at least one of the rolls and an actuator operating the positioner, the logic circuit being operatively coupled with the actuator such that the positioner displaces the at least one roll when the actuator receives the control signal and/or increases force exerted by the roll on the strand when the actuator receives the control signal.

12. The casting machine as recited in claim 7 wherein the logic circuit is further configured to calculate an adjustment of a process parameter of the casting machine to shift a location at which the strand substantially solidifies from the determined solidification position toward a desired solidification position on the travel path.

13. The casting machine as recited in claim 7 wherein the logic circuit is provided by an analog computer or a digital processor having memory and a software program loaded within the memory.

14. The casting machine as recited in claim 7 wherein each sensor includes a strain gauge configured to sense loading on a bearing supporting an end of the coupled roll.

15. The casting machine as recited in claim 14 wherein each bearing is mounted within a housing and each strain gauge is disposed on or within the housing.

16. The casting machine as recited in claim 7 wherein each one of the plurality of rolls is provided by a roll line including at least two rolls spaced apart along a common axis of rotation, each roll having opposing ends supported by a separate bearing, each sensor being coupled with one roll of each roll line.

17. The casting machine as recited in claim 7 wherein the plurality of rolls is a first set of rolls and the guide roll assembly further includes a second set of rolls, each one of the second set of rolls being spaced generally perpendicularly with respect to the travel path from a separate one of the first set of rolls so as to form a plurality of pairs of rolls, the strand passing between each one of the pairs of rolls when traversing the travel path.

18. The casting machine as recited in claim 16 further comprising:

first and second frames, at least a portion of the first set of rolls being rotatably coupled with the first frame and at least a portion of the second set of rolls being rotatably coupled with the second frame, at least one of the first and second frames being movable with respect to the other one of the first and second frames to vary loading on the strand; and an actuator coupled with one of the first and second frames and configured to displace the coupled frame in opposing directions generally perpendicular to the travel path.

* * * * *